US007946516B1

(12) United States Patent
Schantz et al.

(10) Patent No.: US 7,946,516 B1
(45) Date of Patent: May 24, 2011

(54) FEED CHUTE FOR VERTICAL ROLLER MILL

(75) Inventors: Dwayne R. Schantz, Bethlehem, PA (US); John S. Salmento, Bethlehem, PA (US)

(73) Assignee: FLSmidth A/S, Valby (DK)

( * ) Notice: Subject to any disclaimer, the term of this patent is extended or adjusted under 35 U.S.C. 154(b) by 0 days.

(21) Appl. No.: 12/651,083

(22) Filed: Dec. 31, 2009

(51) Int. Cl.
*B02C 15/00* (2006.01)

(52) U.S. Cl. ..... 241/62; 241/119

(58) Field of Classification Search ..... 241/117–121, 241/62
See application file for complete search history.

(56) References Cited

U.S. PATENT DOCUMENTS 4,982,905 A * 1/1991 Holsiepe et al. ..... 241/79.1
5,381,968 A * 1/1995 Lohnherr et al. ..... 241/19
5,971,302 A * 10/1999 Doumet ..... 241/17

* cited by examiner

*Primary Examiner* — Mark Rosenbaum
(74) *Attorney, Agent, or Firm* — Daniel DeJoseph; Aaron M. Pile

(57) ABSTRACT

The invention relates to a roller mill for grinding solid material such as cement raw materials and similar materials, said roller mill comprising a substantially horizontal grinding table and at least two rollers which are configured for interactive operation with said grinding table. The roller mill also comprises a feed chute for delivering solid material to be ground by gravity to said grinding table that is a conveyor that fluidizes the material as it is being delivered to the grinding table.

11 Claims, 5 Drawing Sheets

FEED CHUTE FOR VERTICAL ROLLER MILL

FIELD OF INVENTION

Described is a roller mill for grinding solid material such as cement raw materials, coal and similar materials. The roller mill comprises a horizontal grinding table and at least two grinding rollers, which are configured for interactive operation with the grinding table, and a conveyor to fluidize and convey the material to be ground into the mill.

BACKGROUND OF THE INVENTION

Roller mills for grinding solid material such as cement raw materials are known, for example from U.S. Pat. No. 4,828,189. This known mill is a so-called vertical roller mill and comprises a casing or mill body with a horizontal grinding table mounted for rotation about a vertical axis positioned within the mill body. Drive means such as a motor and a gear reducer, situated beneath the grinding table, are provided for rotating the grinding table.

Material is fed into the roller mill via a feed chute, which is typically positioned co-axially with and at a distance above the grinding table. When utilizing conventional prior art feed chutes there can be sticking problems with certain feed materials which can result in build up and plugging within the chute. To overcome this, the chute angle into the mill is typically increased toward the vertical which can be problematic because this results in increasing the height of feeding equipment and conveyors. With such a solution the velocity of the material hitting the table can also be a concern. In another solution, ports opening into the feed chute can be employed to mechanically clear plugs. However, this method can only be employed when the mill is shut down.

DISCLOSURE OF THE INVENTION

It is the object of the present invention to provide a roller mill with an improved feed chute that overcomes prior art disadvantages.

This object is obtained by means of a roller mill of the kind mentioned in the introduction which utilizes a fluid bed conveyor is utilized to fluidize and convey the material into the mill. In one embodiment a perforated plate of hard, abrasion resistant material can be utilize in the fluid bed conveyor to reduce the wear of the material being conveyed.

DESCRIPTION OF THE DRAWINGS

The invention will now be described in further details by way of an example of a roller mill according to the invention and with reference to the following drawings in which like numerals are employed to designate like parts and in which.

The Figures are not necessarily drawn to scale. In the Figures black arrows depict the direction of feed flow, while lightly shaded arrows show the direction of air flow.

DETAILED DESCRIPTION OF INVENTION

Figure 1:
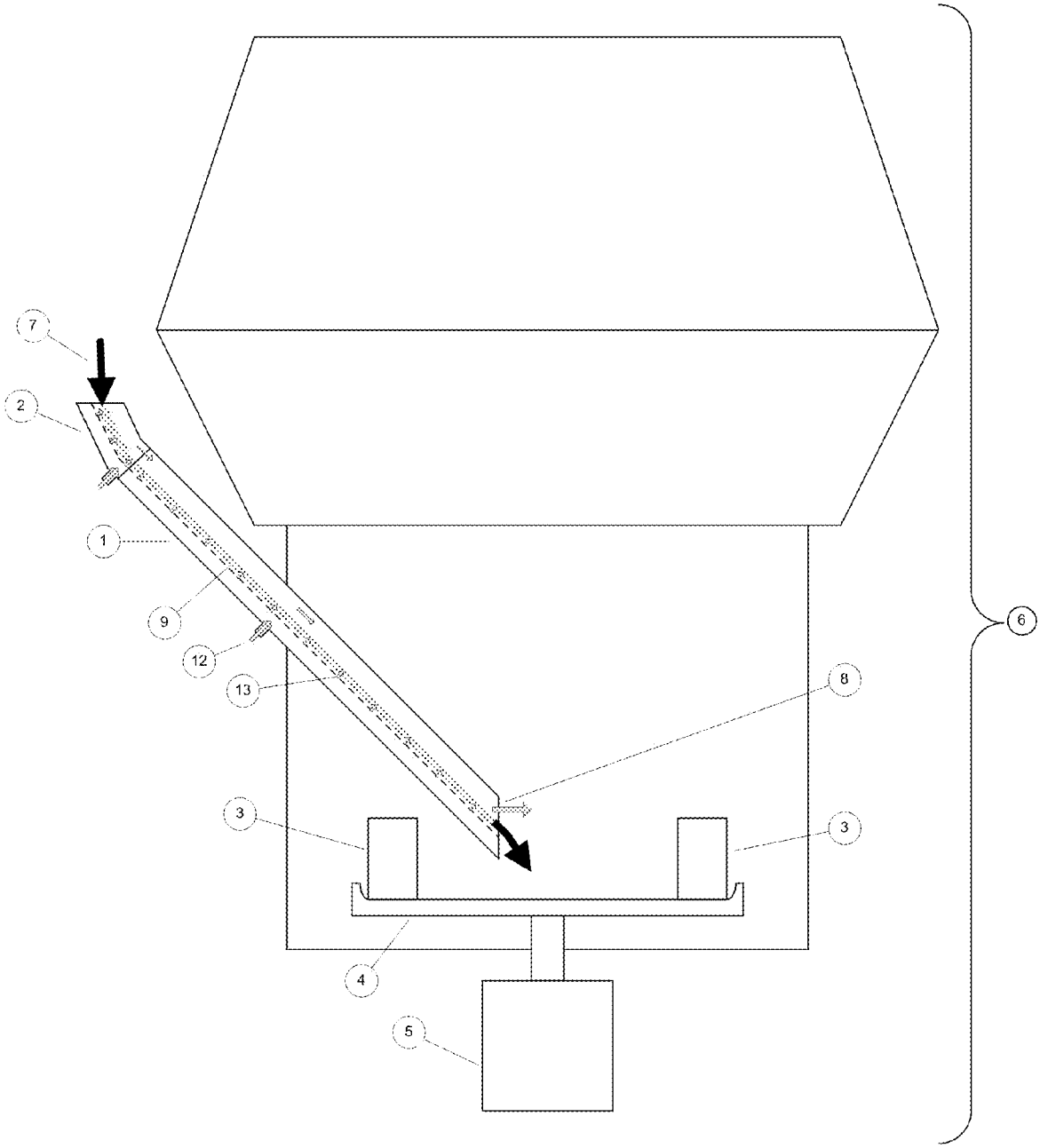
FIG. 1 is a sectional side view of a roller mill of the present invention having a fluidized feed chute with an approximately 45° angle from the horizontal is utilized.

In FIG. 1 is seen a side view of a vertical roller mill 6, which comprises a horizontal grinding table 4 rotating about a vertical axis and driven by gear box/electric motor 5. Rolling on the grinding table 4 are grinding rollers 3 mounted on shafts, not shown, and urged against and operating interactively with the grinding table 4 by means of known, but not shown, pull or pressure means.

Fresh unground material to be fed to the mill is introduced into the mill through a feed inlet 7 located at the top of a fluidized feed chute 1, which in the depicted example is situated at an approximately 45° angle from the horizontal. The fluidized material 9 introduced into the mill through the feed chute 1 is directed to the central part of the grinding table, exiting via outlet 8 from which, through the rotation of the grinding table, the material is flung outwards and ground under the grinding rollers.

As indicated, it is a primary feature of the invention that the feed chute comprises a fluidizing gravity conveyor in the form of an enclosed conduit to convey fluidizable finely divided material such as cement raw meal, finish cement and the like to the mill. The chute includes an inlet 7 at one end for supplying material to be conveyed and an outlet end 8 for discharging material and air from the feed chute. Gaseous fluid under pressure, such as air, is supplied via air entry 12 to the lower plenum chamber 11 for passage upwardly through the gas permeable member 10, which can be a porous ceramic plate or other abrasion resistant air distributor such as stainless steel, high strength polymers such as polycarbonates, polyacrylates, polyurethanes and so forth which, when not naturally porous, will have provided therein a plurality of spaced apart openings therethrough along its entire length and width directions through which gas will flow into upper material chamber 14. Lower plenum chamber 11 will be maintained at a higher pressure than upper material chamber 14, and although upper material chamber 14 may be maintained at a positive, atmospheric or a negative pressure, in a preferred embodiment upper material chamber 14 will be maintained at a negative pressure. When aerated, the fluidized material will flow downwardly above gas permeable member 10 from the inlet to the outlet by gravity. In operation, it is normal to supply ambient air to the lower plenum chamber 11. The air under pressure flows upwardly through gas permeable member 10 to aerate and fluidize the material in the upper material chamber 14. The thus aerated material will then flow downwardly through the conveyor by gravity. When the gas flow through the nozzles stops, the material will tend to deaerate and settle back down on the surface of gas permeable member 10.

Figure 2:
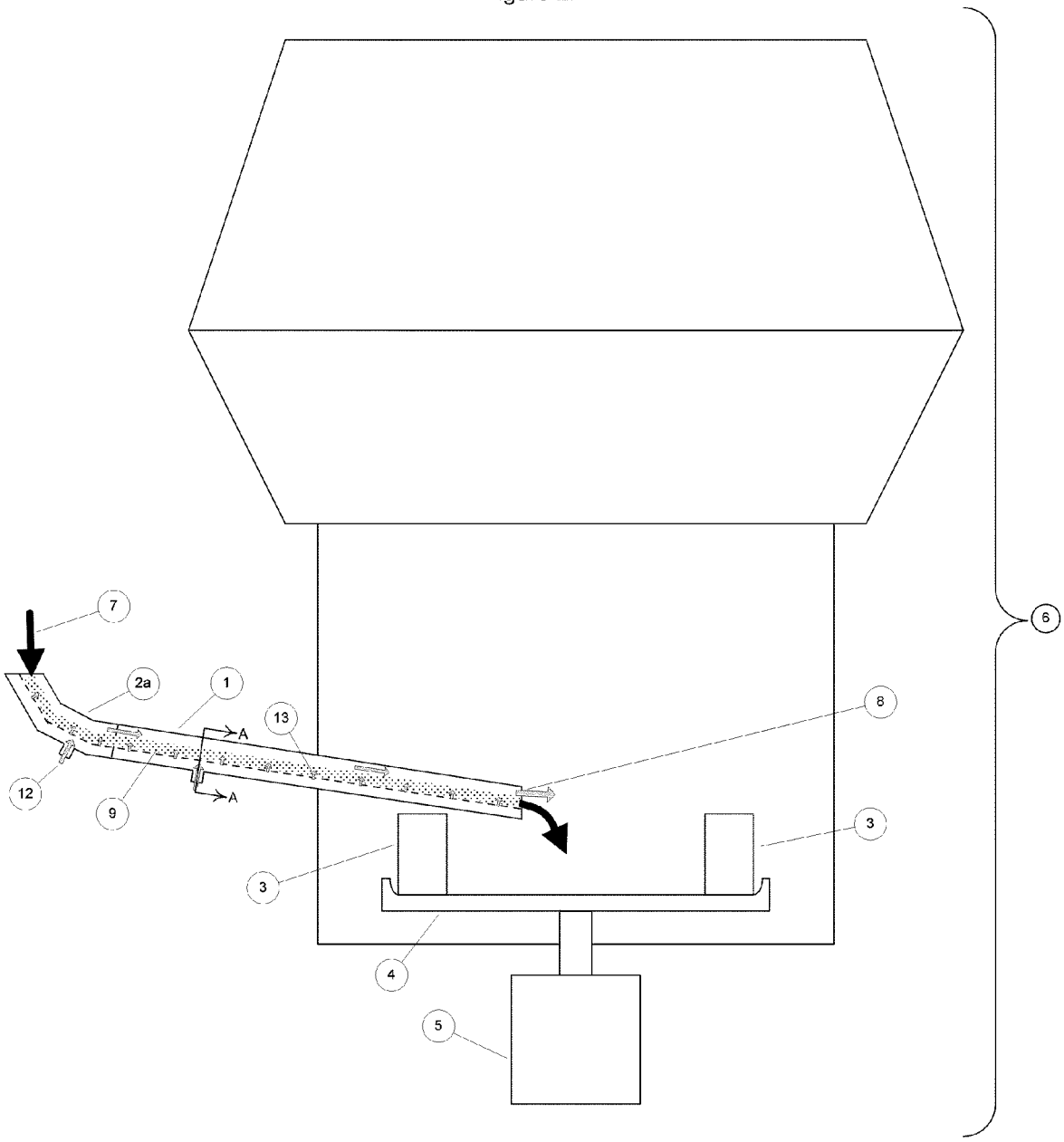
FIG. 2 is a sectional side view of a roller mill of the present invention in which a fluidized feed chute with an approximately 10° angle from the horizontal is utilized.

The embodiment of FIG. 2 is essentially identical to FIG. 1 except that fluidized feed chute 1 is situated at an approximately 10° angle from the horizontal. In practice the slope of the chute is generally dictated by the room available, and the nature and flow properties of the material. In the case of material that is too large to be readily fluidizable, a larger slope is preferred, and the air flow into the upper material chamber will help to move the material down through the feed chute. In such case, the movement of the material down the feed chute will also be facilitated if a small amount (5%-10%) of ground (and thus fluidizable) material is recycled from the mill table to the feed chute inlet. In effect, such fluidizable material will help to "carry along" the larger non-fluidizable material.

The slope of the feed chute and position of the feed chute can also be reduced to lower heights of conveyors and feeders. Most preferably, feed chutes having an angle between about 10° and about 55° from the horizontal are advantageously utilized in the present invention.

Figure 3:
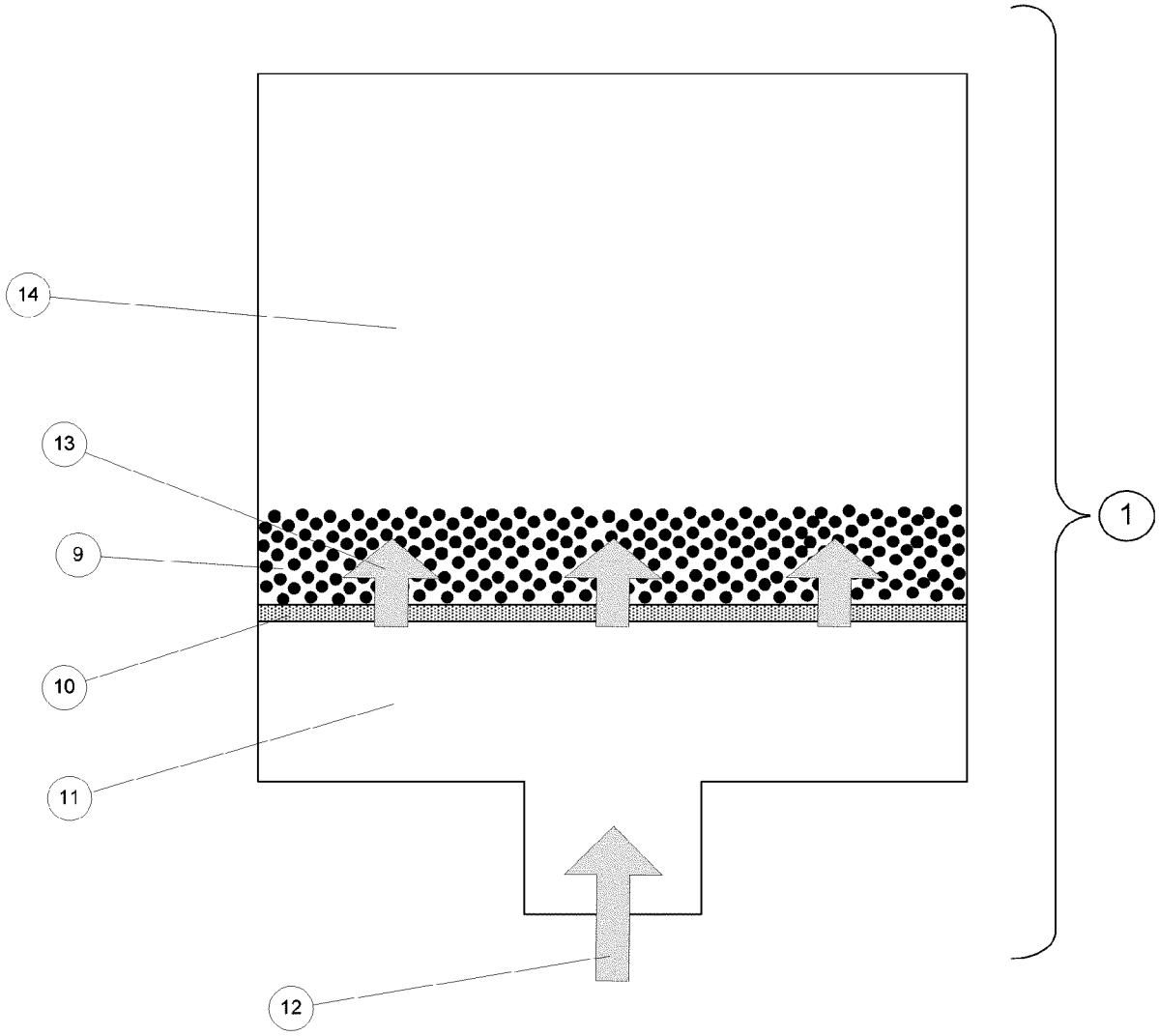
FIG. 3 is a cross-sectional cut taken on the line of A-A of FIG. 2 of a feed chute utilized in the present invention.
Figure 4:
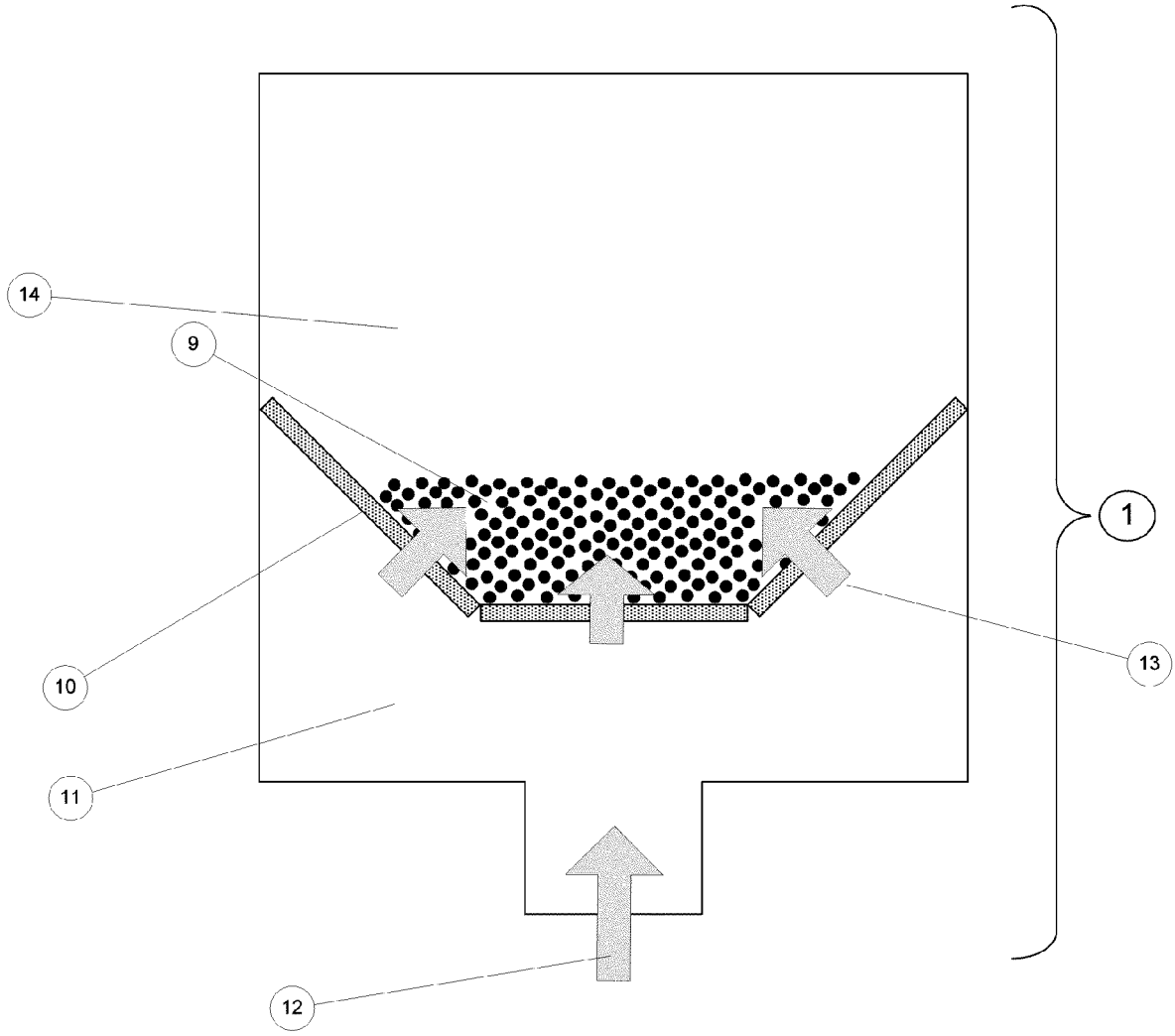
FIG. 4 is a cross-sectional cut of another embodiment of a feed chute utilized in the present invention.

FIG. 3 shows a cross-sectional view of a fluidized feed chute having a substantially box-like configuration used in the present invention in which a flat fluidizing plate, or gas permeable member, 10 is employed through which fluidizing air, represented by arrows 13, passes. The embodiment of FIG. 4 is similar to that of FIG. 3 in all respects except that a fluidizing plate 10 having a trough, rather than a flat, configuration is utilized. One advantage of using a trough configuration is that it reduces the friction on the material being conveyed. In a conventional flat arrangement the side walls will be a source of friction. Such friction will not be as pronounced in a trough-shaped fluidizing plate arrangement which transitions from a central flat portion to a sloped portion, since the slope portion is also fluidized which reduces friction. Another advantage to a trough arrangement is that there tends to be a deeper material bed. Such a deeper bed is particularly advantageous when conveying larger, essentially non-fluidizable material in a "river" of smaller fluidizable particles.

An optional method to help convey the feed material is to immediately direct the fluidization air upon entering the material chamber 14 essentially in the same direction as the flowing feed material. The momentum of the incoming fluidizing air will thereby help to push along the feed material as well as fluidize it. One means to accomplish this is to provide a gas permeable member 10 which is not naturally porous and has at least some holes or slots provided therein which are angled in the direction of exit 8.

Figure 5A:
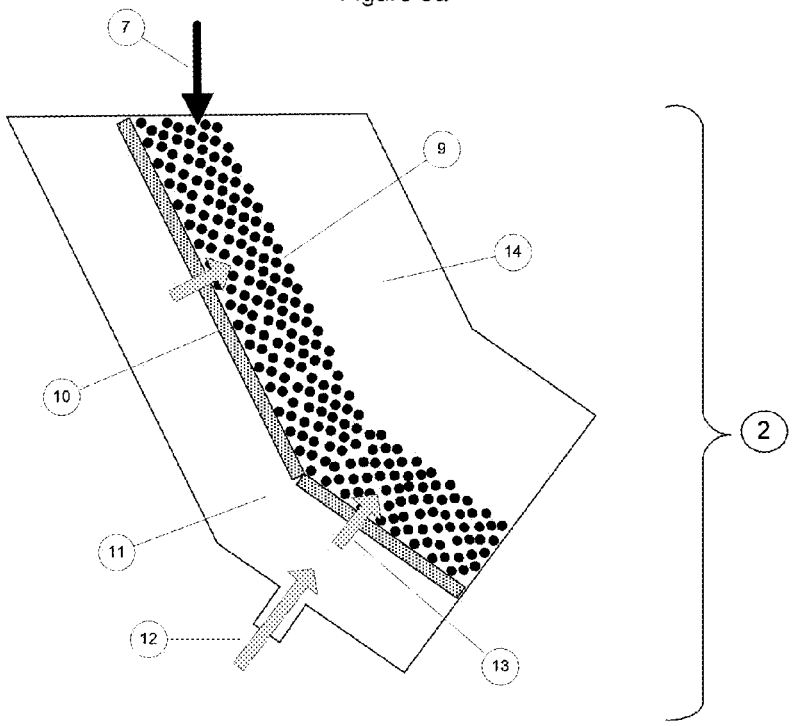
FIGS. 5*a* and 5*b* are sectional side views of two transition pieces that can be utilized in the present invention.
Figure 5B:
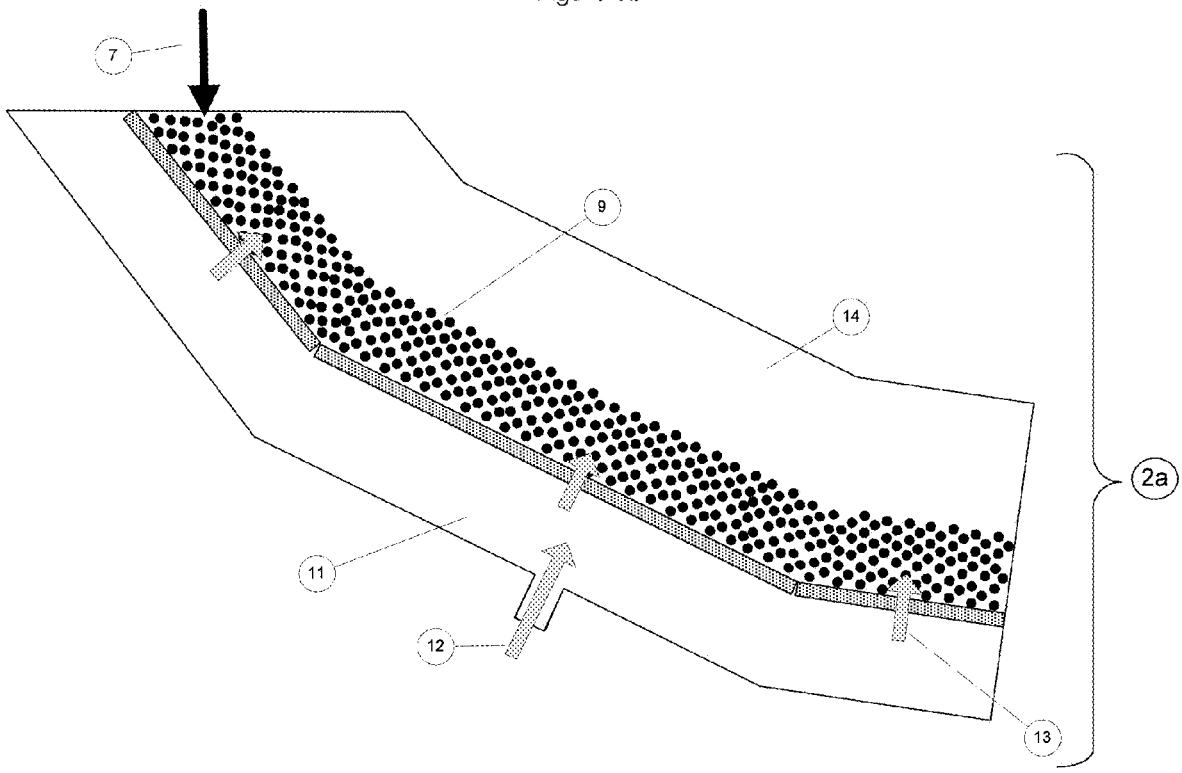

In both FIG. 1 and FIG. 2 there is depicted the use of a mitered fluidized transition piece, numbered respectively as 2 and 2*a*, which is used to transition the material from an almost straight vertical fall at the feed inlet to the desired slope throughout the length of the fluidized feed chute into the vertical roller mill. The transition pieces are shown in greater detail in FIGS. 5*a* and 5*b*. The transition pieces 2, 2*a* consist of a series (two in transition piece 2, three in transition piece 2*a*) of short, straight conveying sections. Each of the sections serves to gradually turn the material from the slope at which the material enters the inlet 7 toward the desired slope through at which the material will be conveyed through feed chute 1. The main advantages of utilizing the mitered inlet in such applications is that it conserves the momentum of the falling material thus helping to convey larger, essentially non-fluidizable material, which further minimizes the chance of blockages and reduces the possibility of chunks of material causing damage to fluidizing plate 10.

From the foregoing it should be apparent that the objects of the present invention have been carried out. It is intended that the foregoing be a description of a preferred embodiment and that the invention be limited solely by that which is within the scope of the appended claims.

What is claimed is:

1. A roller mill for grinding solid material comprising cement raw materials and coal, said roller mill comprising a substantially horizontal grinding table, rollers which are configured for interactive operation with said grinding table and a feed chute for delivering solid material to be ground by gravity to said grinding table, wherein said feed chute comprises a conveyor that fluidizes said material and delivers said fluidized material to the grinding table, said feed chute having a material inlet at one end and a material outlet at its other end and a gas permeable member serving as a gas distributor mounted in said conduit that divides said conduit into an upper material chamber and a lower plenum chamber that is connected to a source of material fluidizing gas under pressure, wherein said member is porous to the passage of material fluidizing gas from the lower plenum chamber into the upper material chamber substantially along the member's entire length.

2. The roller mill of claim 1 wherein the feed chute is positioned at an angle of from about 10° and about 55° from the horizontal.

3. The roller mill of claim 1 wherein said gas permeable member is a substantially flat surface.

4. The roller mill of claim 1 wherein said gas permeable member is in the form of a trough.

5. The roller mill of claim 1 wherein the lower plenum chamber is maintained at a higher pressure than said upper material chamber.

6. The roller mill of claim 1 wherein the upper material chamber is maintained at a negative pressure.

7. The roller mill of claim 1 wherein the upper material chamber is maintained at a positive pressure.

8. The roller mill of claim 1 wherein the upper material chamber is maintained at atmospheric pressure.

9. The roller mill of claim 1 wherein the gas permeable member is comprised of a porous ceramic plate.

10. The roller mill of claim 1 wherein the gas permeable member is comprised of a material that is not naturally porous in which a plurality of spaced apart openings are provided through which air can flow from the lower plenum chamber to the upper material chamber.

11. The roller mill of claim 10 wherein at least some of the openings are angled toward the material outlet to thereby direct the gas in the direction of feed flow immediately upon its entry into the upper material chamber.

* * * * *